United States Patent [19]

Legger et al.

[11] Patent Number: 4,462,592

[45] Date of Patent: Jul. 31, 1984

[54] METALLIC FRAME FOR TENNIS RACKETS

[76] Inventors: Roberto Legger, Via Galluzia 1, Banchette (Torino); Lorenzo Amosso, Via Giuseppe Giacosa 49, Colleretto Giacosa (Torino); Eligio Legger, Via Galluzia 1, Banchette (Torino), all of Italy

[21] Appl. No.: 400,239

[22] Filed: Jul. 21, 1982

[30] Foreign Application Priority Data

Jul. 22, 1981 [IT] Italy ..... 23076 A/81

[51] Int. Cl.[3] ..... A63B 49/12

[52] U.S. Cl. ..... 273/73 D; 273/73 H

[58] Field of Search ..... 273/73 E, 73 C, 73 D, 273/73 R, 73 H, 73 L; D21/211-213

[56] References Cited

U.S. PATENT DOCUMENTS

| | | | |
|---|---|---|---|
| 2,145,785 | 1/1939 | Aubert | 273/73 E |
| 2,456,023 | 12/1948 | Rosenbalm | 273/73 E |
| 3,884,467 | 5/1975 | Sommer | 273/73 D |

*Primary Examiner*—Richard C. Pinkham
*Assistant Examiner*—Matthew L. Schneider
*Attorney, Agent, or Firm*—Shlesinger, Fitzsimmons & Shlesinger

[57] ABSTRACT

The invention relates to a metallic frame for tennis rackets formed by a tubular section in the interior of which there is freely housed an elongate resiliently yieldable crown-like ring structure carrying a plurality of members for anchoring and guiding the strings. The members are mounted on the ring structure in a freely oscillatory way and spaced apart from each other. The crown-like ring structure is made of a metallic wire piece which is bent in a fretwork fashion so as to have formed intermediate its ends a plurality of spaced, transversely extending spokes which carry the oscillatory members and which are interconnected by a plurality of spaced, longitudinally extending spokes which lie in a generally sinusoidal path around the inside of the frame section.

6 Claims, 4 Drawing Figures

METALLIC FRAME FOR TENNIS RACKETS

Frames for tennis rackets are known which consist of a metallic section to which the strings are secured by resiliently yieldable fastening means.

Rackets of the kind referred to above are disclosed, for example, in the U.S. Pat. Nos. 3,078,098; 3,206,203, and in the German Utility Model No. 7,804,107.

More detailedly, the rackets disclosed in the above cited U.S. patents have their strings secured to a metallic resiliently yieldable crown-like ring which is tied to the racket frame proper by a metallic wire.

Such rackets, in addition to their construction being rather intricate, have the shortcoming that their strings can be installed only by trained personnel. In addition, the crown-like rings and the relative wire for bonding it to the frame, inasmuch as they are mounted externally of the racket frame, render the esthetic aspect of the whole racket objectionable.

Another important defect due to the fact that the crown-like ring is external to the frame and is rigidly bound thereto is the fact that the vibrations originated by the impact of the tennis ball are transferred, though dampened, through the frame to the arm of the tennis player and well known disturbances are thus caused, above all the one known as the "tennis player elbow".

Contrarywise, the racket disclosed on the German Utility Model No. 7 804 107 has its strings partially connected to the frame (metallic) of the racket through a plurality of spring-loaded plungers which are housed in seatings specially provided in the interior of the tubular section forming the racket frame.

Such a racket is laborious to construct and is thus expensive, and, furthermore, the vibrations due to the impact of the tennis ball are discharged onto predetermined points of the racket frame so that the dampening effect is unsatisfactory.

An object of the present invention is to offer a remedy to the drawbacks enumerated above by providing a metallic racket frame equipped with resiliently yieldable anchoring means for the racket strings to be tied, said frame being simple and cheap to manufacture and more advantageous in use over those of the prior art.

Having this objective in view, according to the invention, it has been envisaged to provide a frame consisting of a metallic tubular frame which is characterized in that, in its interior, a resiliently yieldable crown-like ring is mounted, which carries a plurality of string-anchoring and guiding members, the latter being mounted on said crown-like ring in a freely oscillable way and spaced apart from each other.

It is preferred that such a crown-like ring is made of a metallic wire repeatedly bent in the fashion of a fretwork, the transversal spokes of which carry said string-anchoring and guiding members whereas its longitudinal spokes are bent in a sinus-curve fashion. By this provision, the "crown" rests only against the inner wall of the frame so that the oscillable string-guiding means are in a suspended condition and the "crown" is freely and resiliently yieldable.

The structural and functional features of the invention and its advantages over the prior art will become still clearer from the scrutiny of the ensuing exemplary description aided by the accompanying drawings wherein.

Having now reference to the drawings, the frame in question consists of a metallic tubular section 10 having, preferably but by no means compulsorily, a pentagonal cross-sectional outline with rounded edges.

In the interior of the section 10 there is housed a longitudinally extending resiliently yieldable crown-like ring 11 of metallic wire carrying a plurality of spaced members 12 for guiding the intersecting racket strings 13, which are strung in the racket frame in the usual manner in intersecting relation to each other. Said members 12 are secured to the crown ring 11 at spaced points therealong, and preferably are made with an antifriction material.

Figure 1:
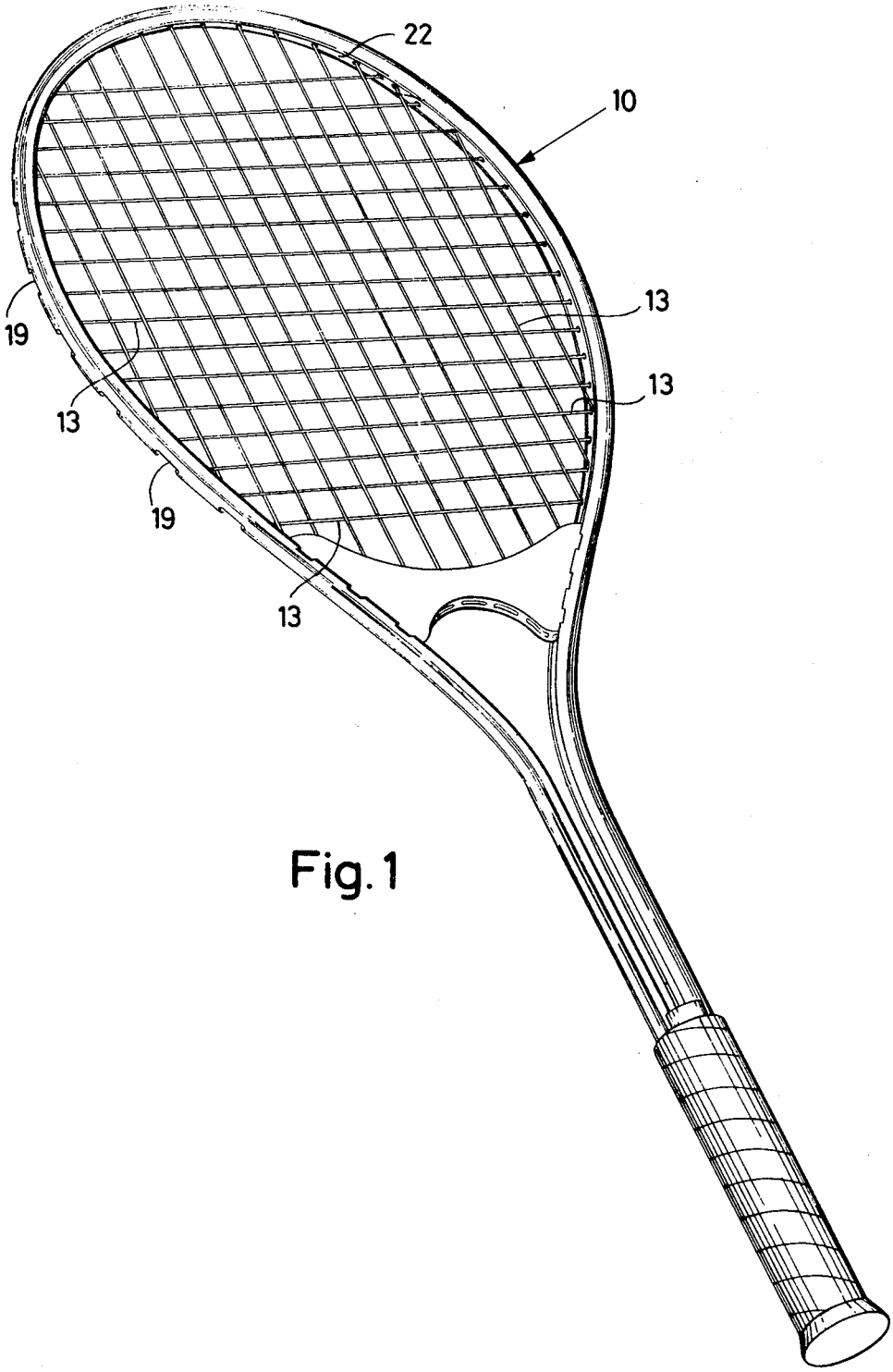
FIG. 1 is a perspective view showing a racket comprising a metallic frame made according to this invention.
Figure 2:
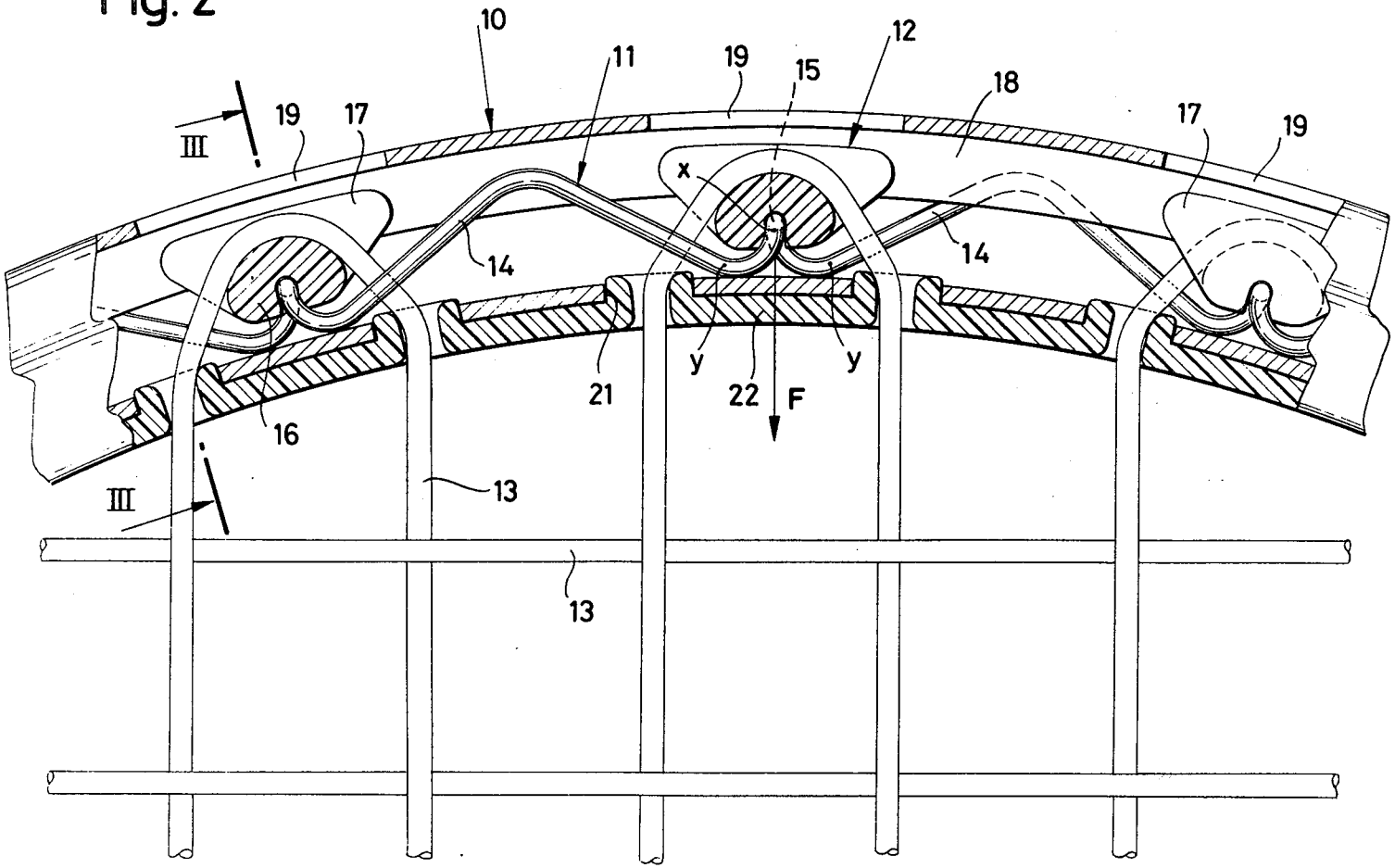
FIG. 2 is a closeup view, shown in longitudinal cross-section, which illustrates a portion of the frame shown in FIG. 1.

The crown 11 is shaped like a fretwork, and comprises alternate, longitudinally extending spokes 14 having a generally sinusoidal trend or path around the inside of section 10 as shown in FIG. 2, and intervening, transversely extending spokes 15 having straight or linear configurations so as to snappingly receive intermediate their ends the members 12, which are freely oscillable. As can be seen clearly in FIGS. 2 and 3 of the drawings, the pieces 12 having a structure which is entirely equivalent to that of a half sheave since they comprise a central rounded body 16 for having a string 13 slidable thereon and two side flanges 17 to hold the string from sliding laterally. These pieces 12 are held suspended in the interior of the section 10, between two spaced parallel webs 18, which project radially inwardly from the outer peripheral side of section 10, by virtue of the sinusoidal trend of the spokes 14 of the crown 11, which rest freely on the confronting inner peripheral surface of the bore in section 10. In correspondence with the members 12, the section 10 has slots 19 and bores 21, in its outer and its inner peripheral sides, respectively, to allow the racket strings 13 to be run therethrough in known manner during stringing. The bores 21 are masked by grommet-shaped projections formed on a strip 22 of an anti-friction material which is snappingly seated within a portion 23 of the section 10.

Figures 3, 4:
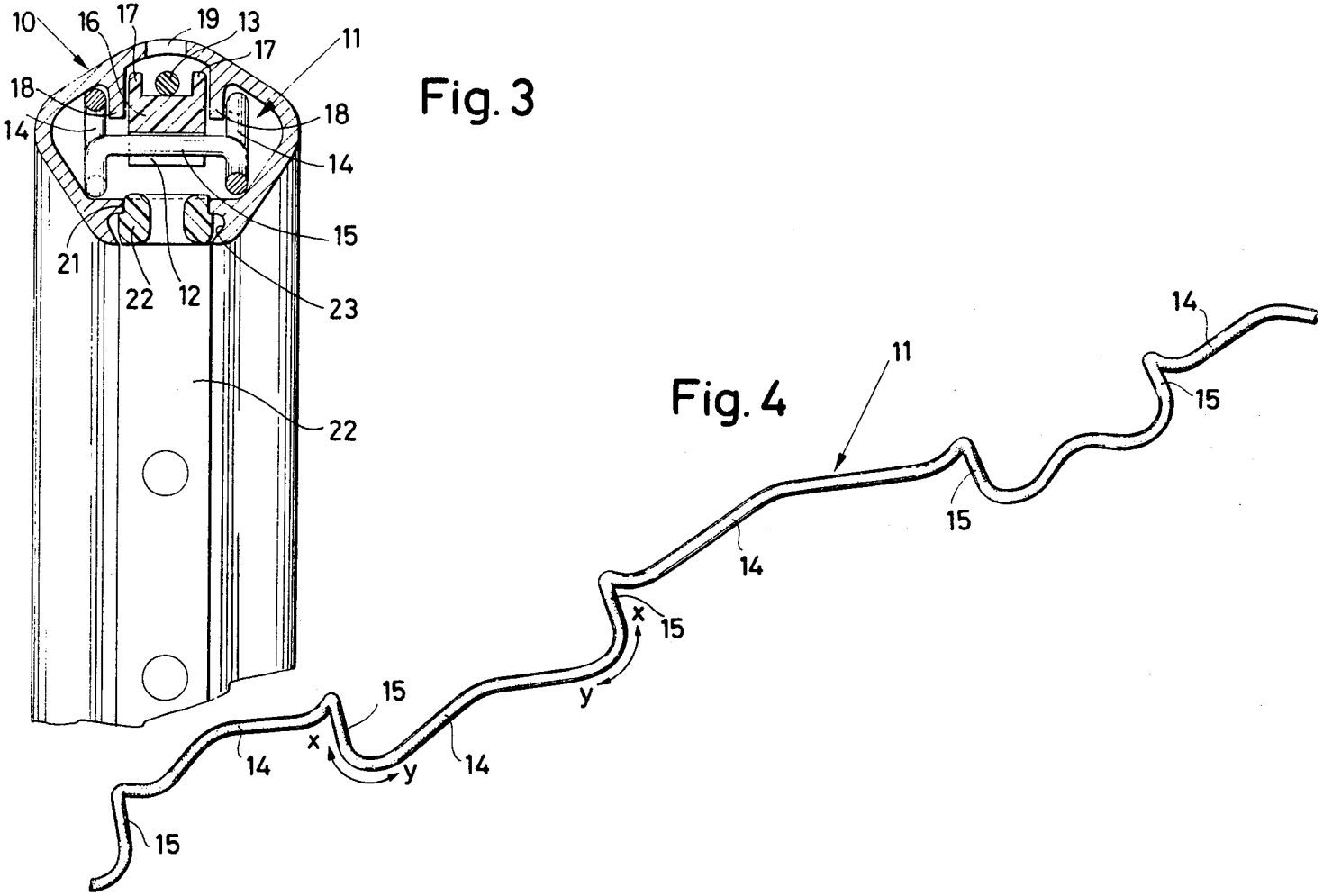
FIG. 3 is a cross-sectional view taken along the line III—III of FIG. 2.
FIG. 4 is a perspective view of the resiliently yieldable crown ring.

Also, as shown more clearly in FIG. 3, each transverse spoke 15 of wire 11 extends at opposite ends beneath the spaced webs 18, thereby to support alternate spokes 14 outwardly of one of the webs 18, and the intervening spokes 14 outwardly of the other web 18.

It is thus apparent from the foregoing that, in a racket containing a frame according to the invention, the strings can be mounted easily and quickly and the vibrations originated by the impact with the tennis ball are predominantly dampened by the ring 11 which is freely housed within the interior of the section 10. The string wear, moreover, is very limited by virtue of the structure and the oscillability of the members 12, and the provision of the masking strip 22, and the fact that the bonds between the frame and the racket strings 13 are all within the section 10 and thus are protected in the case of scratching the racket on the surface of the tennis court.

In addition, with the racket made according to the invention, during the performance of a stroke, the instantaneous impact of the tennis ball against the racket strings originates, in a proportional manner, the following phenomena:

(a) deformation of the planar character of the string grid;

(b) overtension on the strings 13, each being anchored to its corresponding swingable member 12;

(c) increase of the force F, that is, the thrust exerted by the crown 11 onto the frame, and (d) yield of the sinusoidal arc in the XY section which is curved like a leaf spring in the crown 11.

The snapping and "nervy" reaction of the leaf spring portions XY (to be sized by trial and error in field tests) opposing the oncoming force F abruptly recalls the strings (a "sling" effect) and imparts to the tennis ball a velocity which is higher than that obtainable with a known frame, the physical effort for the player during the stroke being the same.

Another advantage is that the strings which have no sharp cornered bends since they are continuously wound around the radiussed body 16 of the members 12, provide a string assembly in which the tensions intercommunicate between any string and the other ones.

The possible slackening of an individual string will then be transferred proportionally to the other strings, consistently with their distance from the slackened string so that the detrimental effect of the slackening is offset to a degree.

By virtue of this principle of intercommunicating tensions, also the string tightening during the string assembly is more convenient and is also more uniform.

We claim:

1. A metallic frame for tennis rackets of the kind comprising an elongate tubular section having therethrough an axial bore, an elongate, resiliently yieldable ring crown extending continuously intermediate its ends longitudinally through the bore in said tubular section, and resting at spaced points therealong against the bore wall of said tubular section, and a plurality of spaced racket string guiding and anchoring members mounted on said crown to be supported thereby resiliently in the bore of said tubular section, and said anchoring members having a string engaging portion, said string engaging portion being positioned within the bore of said tubular section.

2. A frame according to claim 1, characterized in that said members are oscillatably mounted on the crown.

3. A metallic frame for tennis rackets of the kind comprising an elongate tubular section having therethrough an axial bore, an elongate, resiliently yieldable ring crown extending continuously intermediate its ends longitudinally through the bore in said tubular section, and resting at spaced points therealong against the bore wall of said tubular section, and a plurality of spaced, racket string guiding and anchoring members mounted on said crown to be supported thereby resiliently in the bore of said tubular section, said crown being a bent metallic wire comprising a first plurality of spaced spokes which extend transversely of said tubular section and which carry said string anchoring and guiding members, and a second plurality of spaced, longitudinally-extending spokes which are interconnected by said transversely extending spokes, and which are arranged in a sinusoidal path in said section.

4. A frame according to claim 3, characterized in that said members are snappingly engaged on said transverse spokes of said metallic wire upon assembly thereon.

5. A metallic frame for tennis rackets of the kind comprising an elongate tubular section having therethrough an axial bore, an elongate, resiliently yieldable ring crown extending continuously intermediate its ends longitudinally through the bore in said tubular section, and resting at spaced points therealong against the bore wall of said tubular section, and a plurality of spaced, racket string guiding and anchoring members mounted on said crown to be supported thereby resiliently in the bore of said tubular section, said tubular section having a substantially pentagonal cross-section with rounded edges, and having a pair of spaced, internally protruding webs flanking opposite side of said members for confining said members against lateral movement on said crown.

6. A metallic frame for tennis rackets of the kind comprising an elongate tubular section having therethrough an axial bore, an elongate, resiliently yieldable ring crown extending continuously intermediate its ends longitudinally through the bore in said tubular section, and resting at spaced points therealong against the bore wall of said tubular section, and a plurality of spaced, racket string guiding and anchoring members mounted on said crown to be supported thereby resiliently in the bore of said tubular section, each string guiding and anchoring member being shaped in the manner of a half-sheave comprising a rounded central body mounted on said crown to have its outer peripheral surface engagable by a racket string, and having on opposite ends thereof, respectively two side flanges.

* * * * *